US007886476B1

(12) United States Patent
Swan

(10) Patent No.: US 7,886,476 B1
(45) **Date of Patent: *Feb. 15, 2011**

(54) BUFFERED MOUNTING ASSEMBLY WITH MAGNETIC FOOT

(76) Inventor: Richard E. Swan, 171 West St., E. Bridgewater, MA (US) 02333

( * ) Notice: Subject to any disclaimer, the term of this patent is extended or adjusted under 35 U.S.C. 154(b) by 0 days.

This patent is subject to a terminal disclaimer.

(21) Appl. No.: 12/507,905

(22) Filed: Jul. 23, 2009

Related U.S. Application Data

(63) Continuation-in-part of application No. 11/829,587, filed on Jul. 27, 2007, now abandoned.

(60) Provisional application No. 60/820,659, filed on Jul. 28, 2006.

(51) Int. Cl.
*F41G 1/38* (2006.01)

(52) U.S. Cl. ..... 42/127; 42/124; 42/125; 403/374.5

(58) Field of Classification Search ..... 42/72, 42/90, 124–128, 99; 403/374.5, 381
See application file for complete search history.

(56) References Cited

U.S. PATENT DOCUMENTS

| | | | |
|---|---|---|---|
| 2,436,948 | A | 3/1948 | Williams |
| 4,085,511 | A | 4/1978 | Kovac |
| 4,845,871 | A | 7/1989 | Swan |
| 4,934,085 | A | 6/1990 | Lough |
| 5,142,806 | A | 9/1992 | Swan |
| 5,155,915 | A | 10/1992 | Repa |
| 5,276,988 | A | 1/1994 | Swan |
| 5,533,292 | A | 7/1996 | Swan |
| 5,590,484 | A | 1/1997 | Mooney et al. |
| 5,680,725 | A | 10/1997 | Bell |
| 5,694,712 | A | 12/1997 | Plonka |

(Continued)

FOREIGN PATENT DOCUMENTS

| | | | |
|---|---|---|---|
| DE | 2006011542 | U | 12/2006 |

OTHER PUBLICATIONS

A.R.M.S. #19 Dovetail/Stanag Throw Lever Scope Mount, www.mountsplus.com/miva/merchant.mvc?page=MSP/PROD.

(Continued)

*Primary Examiner*—J. W Eldred
*Assistant Examiner*—Gabriel J Klein
(74) *Attorney, Agent, or Firm*—Barlow, Josephs & Holmes, Ltd.

(57) ABSTRACT

A mounting assembly for mounting accessories to a dovetail rail on a firearm is provided. The mounting assembly includes a main body having a lower portion with a first engagement member extending downwardly along one side thereof and a clamping assembly installed into the main body opposite the engagement member such that the clamping assembly can be engaged and disengaged with the dovetail rail to hold the mounting assembly on the dovetail rail. In addition, a buffer pad is provided between the clamping assembly and the interface point on the dovetail rail to protect the rail from wear. The clamping assembly includes a means for retracting the buffer pad when the clamping assembly is in the disengaged position, the retraction means preferably being magnetic. Such that the buffer pad is held out of the way when mounting or dismounting the mounting assembly.

9 Claims, 9 Drawing Sheets

U.S. PATENT DOCUMENTS

| | | | | |
|---|---|---|---|---|
| 5,847,535 | A * | 12/1998 | Nordquist et al. | 318/700 |
| 5,937,559 | A * | 8/1999 | Jennen | 42/94 |
| 6,449,893 | B2 | 9/2002 | Spinner | |
| 6,598,330 | B2 | 7/2003 | Garrett et al. | |
| 6,598,333 | B1 | 7/2003 | Randazzo et al. | |
| 6,629,381 | B1 | 10/2003 | Keng | |
| 6,922,934 | B1 | 8/2005 | Huan | |
| 6,931,778 | B1 | 8/2005 | Nelson et al. | |
| 7,272,904 | B2 * | 9/2007 | Larue | 42/127 |
| 2002/0170224 | A1 * | 11/2002 | Lawless | 42/71.02 |
| 2004/0000083 | A1 | 1/2004 | Grant, Jr. | |
| 2006/0123686 | A1 | 6/2006 | Larue | |
| 2006/0162227 | A1 | 7/2006 | Samson | |

OTHER PUBLICATIONS

TM-9-4931-710-14&P, Technical Manual, Operator, Organizational, Direct Support and General Support Maintenance Manual, Headquarters, Department of the Army, Aug. 1986.

PentagonLight, "A.R.M.S. Mount Safety Latch", http://www.pentagonlight.com/item.detail.cfm.

* cited by examiner

BUFFERED MOUNTING ASSEMBLY WITH MAGNETIC FOOT

CROSS-REFERENCE TO RELATED APPLICATIONS

This application is a continuation in part of U.S. patent application Ser. No. 11/829,587, filed Jul. 27, 2007, which is related to and claims priority from earlier filed U.S. Provisional Patent Application No. 60/820,659, filed Jul. 28, 2006.

BACKGROUND OF THE INVENTION

The present invention relates generally to accessory mounting assemblies for combat weapons such as the modular integrated accessory systems found on most modern combat weapons. More specifically, the present invention relates to an accessory mounting assembly that includes a buffer pad to prevent damage to the rail when the mounting assembly is engaged therewith, while also including a means for reliably retracting the buffer pad to facilitate dismounting when the mounting assembly is disengaged.

As the field of combat and commercial weaponry expands, numerous add-on enhancements have become available for attachment to standard firearms, thereby significantly upgrading the capability of the firearm. Of particular interest in the area of combat weapons is the well-known M16/M4 weapon system (M16 and M4 are trademarks of Colt Defense, Inc.). The M16 has been in service for a number of years and will continue to be a popular rifle both in U.S. and foreign militaries for the foreseeable future. Generally, the M16/M4 weapon 2, as depicted in FIG. 1, includes a lower receiver 4, upper receiver 6, butt stock 8, and barrel 10.

The newer models of the M16/M4 weapons further include a mil-std 1913 dovetail rail 12 extending along the top of the upper receiver. This integrated receiver rail 12 provides a convenient mounting point for many types of enhancement devices such as scopes and other sighting devices. However, space on the upper receiver rail 12 is limited, and many military personnel often have multiple sighting devices that are each tailored to perform in different combat situations. In addition, there are a variety of lighting devices, handgrips, etc. that could also be attached to the weapon for enhanced use of the weapon. The difficulty is that there is simply not enough space on the integrated rail provided on the upper receiver to accommodate all of the desired accessories. Accordingly, the increasing development and refinement of laser sights, infrared lighting, visible lighting, night vision, and specialized scopes and magnifiers, and other accessories continues to drive the need for versatile and reliable integration systems that include additional mil-std 1913 dovetail rails positioned above or around the barrel of the weapon that can support this important equipment and yet stand the test of rugged military use and abuse.

Responding to this need, the applicant has developed a modular integrated rail system (A.R.M.S.® S.I.R.® system), which has been well received by the military and has become popular with several branches of the military (See FIG. 2). The A.R.M.S. S.I.R. system is fully described in U.S. Pat. No. 6,490,822, the entire contents of which are incorporated herein by reference. These modular integrated rail systems for combat weapons 2 generally include an upper hand guard 14, a means 16 for securing the upper hand guard 14 to the weapon 2, a lower firearm accessory 18 (in most cases this is a lower hand guard), various optional rail segments, and in many cases, a sling swivel 20 for attaching a shoulder sling to carry the weapon 2.

The upper hand guard 14 is the main structural element of the system. The upper hand guard is 14 generally semi-cylindrical in shape and has a forward end and a rearward end and a mil-std 1913 dovetail rail 22 extending longitudinally between the forward end and the rearward end. The semi-cylindrical upper hand guard 14 further includes symmetrically opposing side walls that extend outwardly and downwardly from the dovetail rail and terminate in symmetrically opposing longitudinally extending mounting channels. The mounting channels are used to mount various accessories, such as a lower hand guard 18 or a grenade launcher, to the upper hand guard 14.

An interface means 16 is provided at the rearward end of the upper hand guard 14 to removably secure the upper hand guard 14 to the firearm 2. In the original S.I.R. system as shown in U.S. Pat. No. 6,490,822, the clamp is an elongated clamping rail that secures the upper hand guard 14 to the dovetail rail 12 on the top of the upper receiver 6 of the weapon 2. In the newer S.I.R. systems, the interface means is a U-shaped yoke or clamp that secures the upper hand guard 14 to the barrel nut.

As is well known in this area, field modification of weapons is critical in combat situations. For example, it may be desired to swap the lower hand guard for a grenade launcher, which can be attached to the upper hand guard, or to add an optional rail segment for securing an added accessory. Similarly, there may be a desire to exchange various different sights or lighting accessories that are mounted on the various dovetail rails positioned around the weapon. In this regard standardized accessory mounting assemblies have been developed to allow quick and easy removal and mounting of these devices relative to the dovetail rails.

The difficulty with the prior art mounting assemblies is that the clamping surfaces that engage with the dovetail rail are necessarily formed from steel while the Weaver interfaces, receiver sleeves and upper receivers are generally made of aluminum or other light weight material. Since these materials are softer than the steel used for the clamping surface, over time and after repeated use, the operation of the clamping foot scratches, cuts and erodes the underlying rail interface.

To overcome the difficulties associated with the wear between the dissimilar metal surfaces, the applicant further developed a rugged mounting assembly that includes a buffer pad 24 disposed between the clamping surface 26 of the mounting assembly 28 and the rail interface 22 (See FIGS. 3A and 3B) that enhances the ability to fasten accessories onto the SIR system as is shown and described for example in U.S. Pat. No. 5,276,988, the entire contents of which are incorporated herein by reference.

However, the inclusion of a buffer pad itself has also introduced a new set of difficulties in that when the mounting assembly is disengaged and the clamping foot is retracted, the buffer pad often remains in a downwardly depending position as can best be seen in FIG. 3B. As a result, when installing a mounting assembly that includes a buffer pad, the device must be tilted in such a manner that the buffer pad is cleared out of the way, otherwise it interferes with installation of the mounting assembly onto the rail interface.

Accordingly, there is a need for a mounting assembly that allows for the releasable mounting of various accessories onto the standard dovetail rail found on modern combat weapons. Further, there is a need for a mounting assembly that includes the beneficial features found in the prior art throw while also including a reliable means for retracting the buffer pad in a manner that facilitates installation and removal of the device relative to an S.I.R. system or other interface rail mount.

BRIEF SUMMARY OF THE INVENTION

In this regard the present invention provides for an improved mounting assembly that is configured to be releasably attached to a standard dovetail rail profile. The mounting assembly of the present invention is particularly suited for use in connection with any firearm that utilizes a standard dovetail rail system. The mounting assembly is configured in the same manner as a traditional prior art mounting assemblies as pictured in FIGS. 3A and 3B. The mounting assembly includes a main body that has a lower portion that is configured to engage the dovetail rail found on most modern combat weapons as depicted at 12 in FIG. 1 and at 16 In FIG. 2 and an upper portion that can take a variety of configurations depending on the accessory that is to be mounted thereon. The lower portion of the mounting assembly has a first engagement member extending downwardly along one side thereof for engaging one side of the dovetail rail. A clamping assembly that includes a camming member having a foot and a shaft extending upwardly therefrom is installed into the main body opposite the engagement member and is received in a position adjacent the bottom of the mounting assembly body. An actuator arm is installed onto the top end of the shaft adjacent the top of the main body in a manner that engages the shaft and provides a means for the user to rotate the shaft and the foot such that the foot can be engaged and disengaged with the dovetail rail to hold the mounting assembly on the dovetail rail. In addition, a buffer pad is provided between the foot and the interface point on the dovetail rail to protect the rail from wear due to the clamping action.

In the scope of the present invention, the clamping assembly includes a means for retracting the buffer pad when the clamping assembly is in the disengaged position. Retracting the buffer pad and holding it out of the way in turn makes installation of the mounting assembly relative to the dovetail rail easier. In the preferred embodiment, the means for retracting the buffer pad is magnetic. The foot of the clamping assembly may be entirely formed from magnetic material, may include a magnet installed therein or alternately be coated with a magnetic paint to impart magnetism thereto.

Accordingly, it is an object of the present invention to provide an improved mounting assembly that allows for the releasable mounting of various accessories onto the standard dovetail rail found on modern combat weapons. Further, it is an object of the present invention to provide a mounting assembly that can be reliably mounted onto a dovetail rail while including a clamping assembly that retracts fully when in the disengaged position thereby enhancing the ability of the user to quickly mount or dismount the mounting assembly relative to the dovetail rail. It is still a further object of the present invention to provide a mounting assembly that includes a means for fully retracting the buffer pad when the clamping assembly is in the fully open position thereby ensuring that the buffer pad does not interfere with installing or removing the mounting system relative to the dovetail rail.

These together with other objects of the invention, along with various features of novelty that characterize the invention, are pointed out with particularity in the claims annexed hereto and forming a part of this disclosure. For a better understanding of the invention, its operating advantages and the specific objects attained by its uses, reference should be had to the accompanying drawings and descriptive matter in which there is illustrated a preferred embodiment of the invention.

BRIEF DESCRIPTION OF THE DRAWINGS

In the drawings which illustrate the best mode presently contemplated for carrying out the present invention.

DETAILED DESCRIPTION OF THE INVENTION

Figure 1:
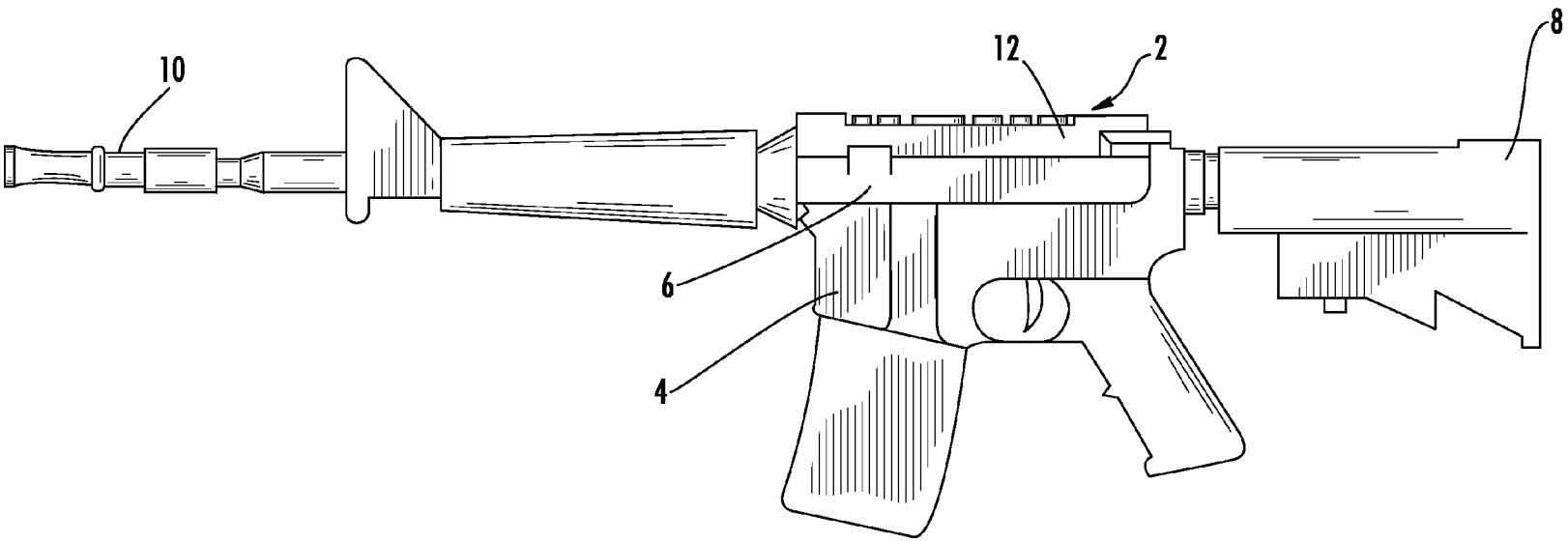
FIG. 1 (PRIOR ART)
FIG. 1 is a side view of a prior art combat firearm.
Figure 2:
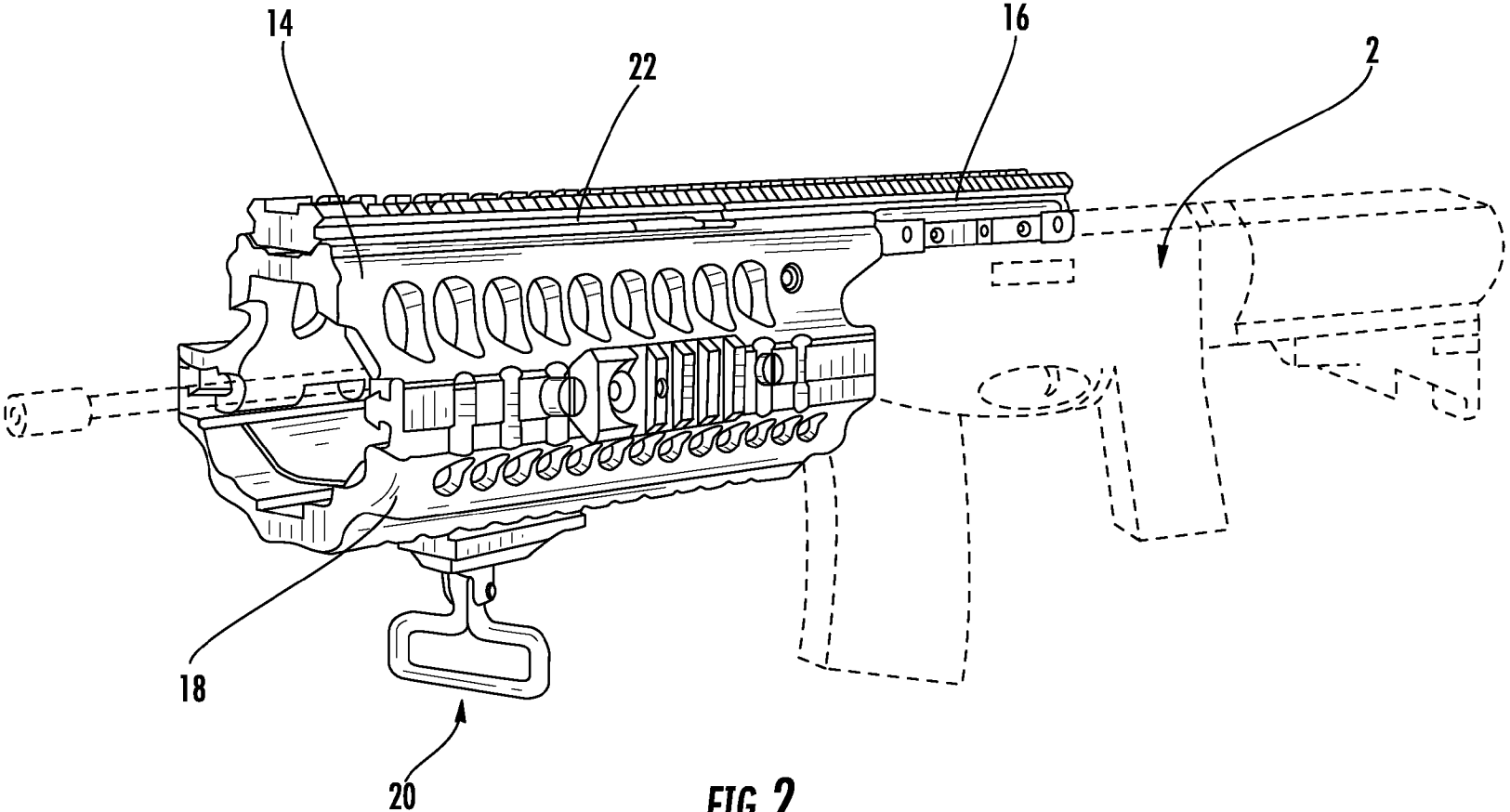
FIG. 2 (PRIOR ART)
FIG. 2 is a perspective view of a prior art rail interface system.
Figure 3A:
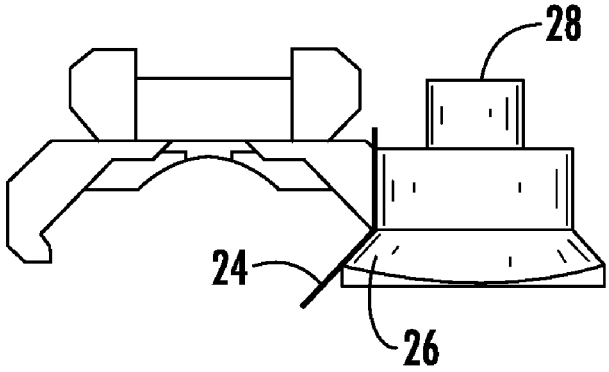
FIG. 3A (PRIOR ART)
FIG. 3A is an end view of a prior art mounting assembly in the engaged position.
Figure 3B:
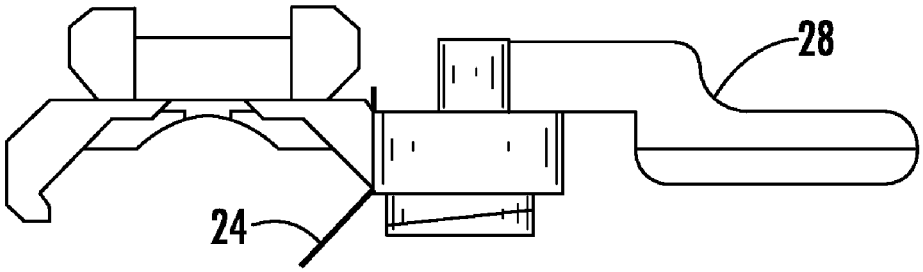
FIG. 3B (PRIOR ART)
FIG. 3B is an end view of a prior art mounting assembly in the disengaged position.
Figure 4:
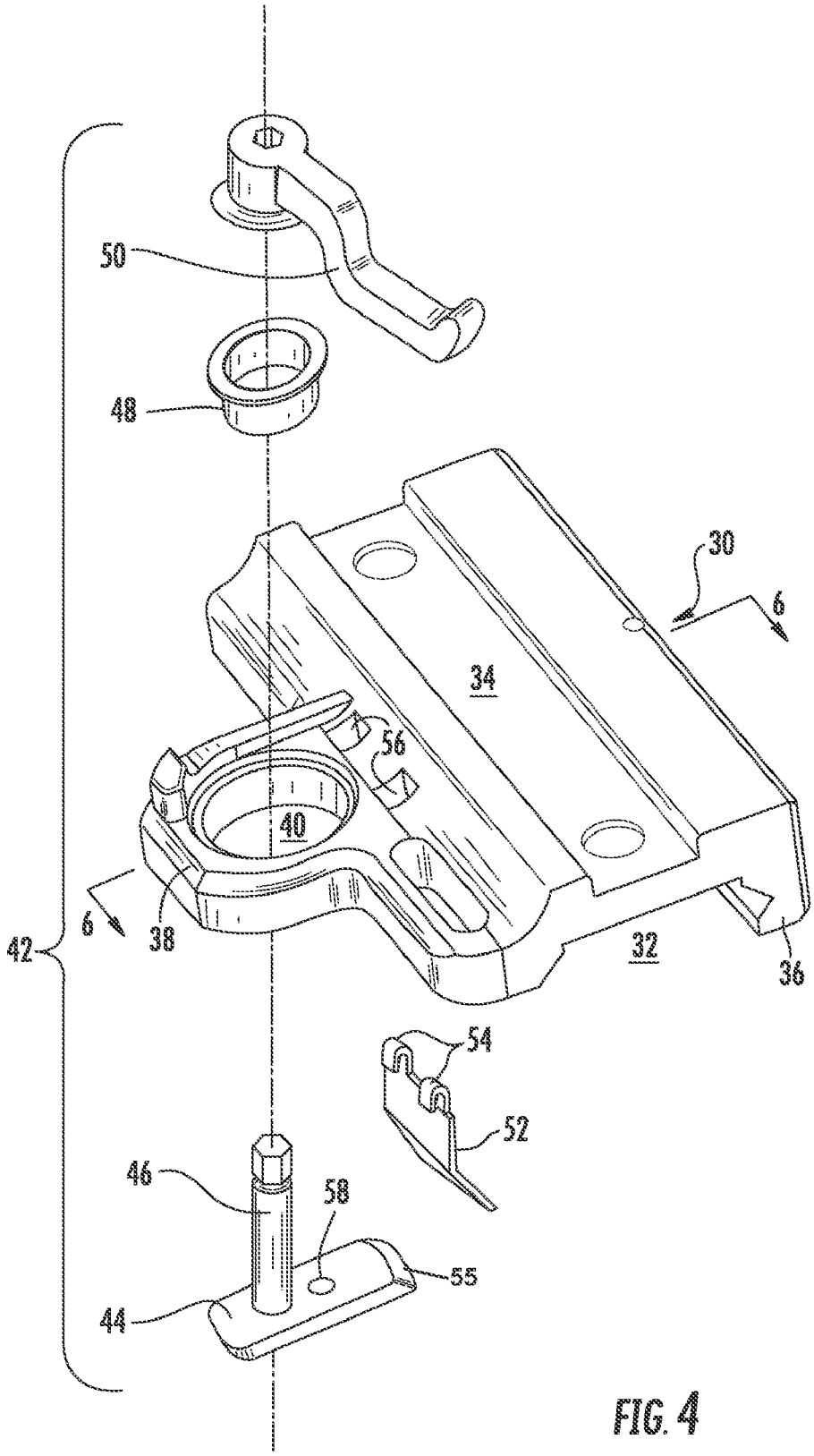
FIG. 4 is an exploded perspective view of the mounting assembly of the present invention.
Figure 5A:
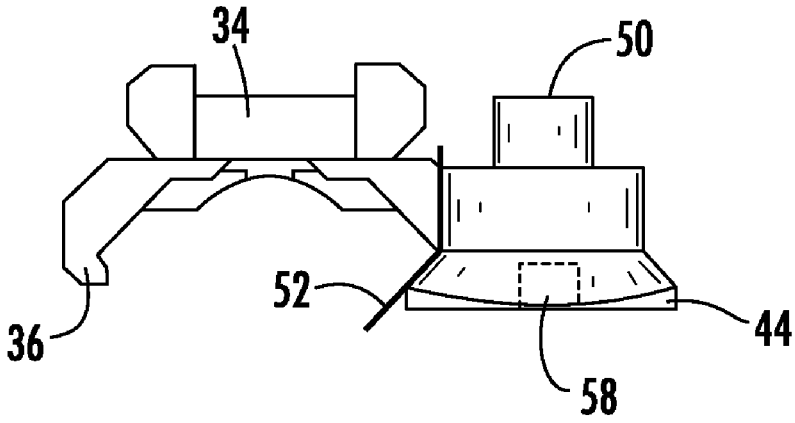
FIG. 5A is an end view of the mounting assembly of the present invention in the engaged position.
Figure 5B:
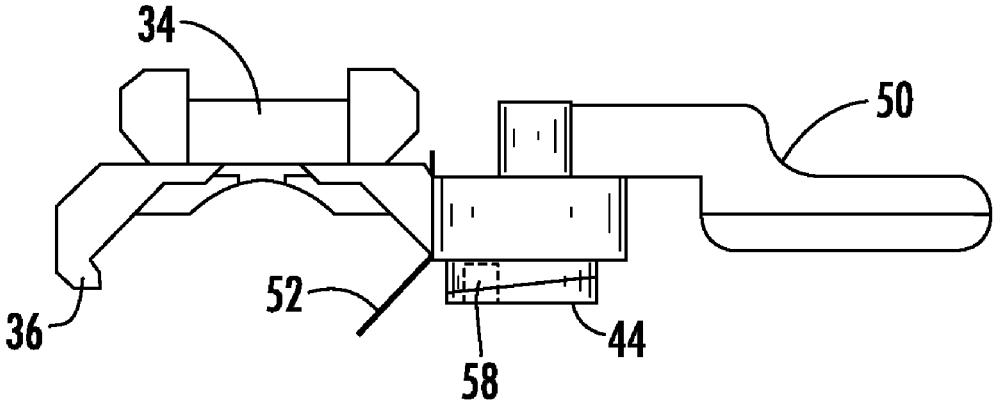
FIG. 5B is an end view of the mounting assembly of the present invention in the disengaged position.
Figure 6:
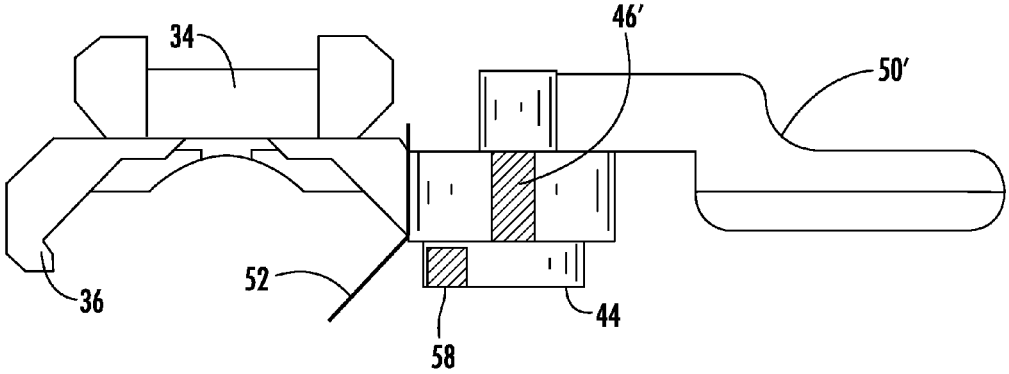
FIG. 6 is a cross sectional view taken along line 6-6 of FIG. 4.

Now referring to the drawings, the mounting assembly of the present invention is shown and generally illustrated at 30 in FIGS. 4-6. The mounting assembly 30 is configured to be releasably attached to a standard dovetail rail profile as is depicted in FIGS. 1 and 2, and includes a means for withdrawing the clamping mechanism away from the dovetail rail when the clamping assembly is in the fully opened position. The mounting assembly 30 of the present invention is particularly suited for use in connection with any firearm that utilizes a standard dovetail rail system. Further, the mounting assembly 30 is configured in the same manner as a traditional prior art mounting interface devices. The mounting assembly 30 includes a lower clamping portion that engages the dovetail rail found on most modern combat weapons and an upper accessory interface portion that can take on a variety of configurations depending on the accessory that is to be mounted thereon.

Turning now to FIG. 4, as can be seen, the mounting assembly 30 includes a main body that is configured in the same manner as a traditional prior art device and further includes a lower portion 32 that is configured to engage the dovetail rail found on most modern combat weapons and an upper portion 34 that can take on a variety of configurations depending on the accessory that is to be mounted thereon. The lower portion 32 of the mounting assembly has a first engagement member 36 extending downwardly along one side thereof for engaging one side of the dovetail rail. Further, a boss formation 38 is provided adjacent the side of the mounting assembly 30 wherein the boss formation 38 includes an opening 40 therein to receive a clamping assembly 42.

The clamping assembly 42 is particularly suited to be releasably engagable with a second side of the dovetail rail such that the clamping assembly 42 cooperates with the first engagement member 36 to retain the mounting assembly 30 in its installed position on the dovetail rail. It is preferred that the clamping assembly 42 be movable between an engaged position wherein the clamping assembly 42 engages the second side of said dovetail rail and cooperates with the first engagement member 36 on the lower portion 32 of the mounting assembly 30 to retain the mounting assembly 30 on the dovetail rail and a disengaged position wherein the clamping assembly 42 is disengaged, thereby allowing the mounting assembly 30 to be removed from the dovetail rail. It is still further preferred that the clamping assembly 42 be rotatable between the engaged and disengaged positions.

In a preferred embodiment the clamping assembly 42 includes a camming member having a foot 44 and a shaft 46 extending upwardly therefrom such that the shaft 46 is installed into the opening 40 in the boss formation 38 on the mounting assembly 30. Further, to enhance the overall fit and rotation of the clamping assembly 42, a bushing 48 may also be provided in the opening 40 between the boss formation 38 and the shaft 46. Once the shaft 46 is inserted into the opening 40 in the boss formation 38, the foot 44 is received in a position adjacent the bottom surface of both the boss formation 38 and the mounting assembly 38 itself. An actuator arm 50 is installed onto the top end of the shaft 46 and is received adjacent the top of the mounting assembly 30. The actuator arm 50 engages the shaft 46 and provides a means for the user to rotate the shaft 46 and the foot 44 allowing the foot 44 to be engaged and disengaged with the second side of the dovetail rail. In this manner, the clamping assembly 42 and the first engagement member 36 cooperate to hold the mounting assembly on the dovetail rail.

There is also shown generally a buffer element 52 having a flat horizontal base portion with an arm 54 at each end of the base extending upwardly at an oblique angle of 135 degrees. The free end of each arm is curved approximately 150 degrees. Two side-by-side openings 56, corresponding in separation to the separation between buffer element 52 arms 54, are formed in the mounting assembly 30. The arms 54 on the top of the buffer element 52 are slid through the openings 56 thereby retaining the buffer element 52 in the mounting assembly 30. In this arrangement, the buffer element 52 is positioned between the surface of the dovetail rail and the foot 44 of the clamping assembly 42. Rotation of the actuator arm 50, the shaft 46 and in turn the foot 44 serves to press the buffer element 52 into the side of the dovetail rail. By placing the buffer element 52 in this position, the buffer element 52 prevents the foot 44 from directly touching and thereby scratching the dovetail rail.

In the scope of the present invention, a magnetic attraction is employed as between the clamping assembly 42 and the buffer element 52 so that as the clamping assembly 42 is moved to the disengaged position, the magnetic force also causes the buffer pad 52 to be withdrawn towards the clamping assembly 42 to a position that is clear from the second side of the dovetail rail 22. Such a magnetic attractive force in the context of the present invention may be accomplished in several different ways. For example, the camming foot 44 may be entirely formed from magnetic material, may include a magnet 58 installed therein or alternately be coated with a magnetic paint to impart magnetism thereto. In such a configuration, the buffer pad 52 is formed from a ferro-magnetic material so that a magnetic attraction exists between the buffer pad 52 and the magnetized camming foot 44. Alternatively, the buffer pad 52 may be entirely formed from magnetic material or may be coated with a magnetic paint to impart magnetism thereto. In such a configuration, the camming foot 44 is formed from a ferro-magnetic material so that a magnetic attraction exists between the magnetized buffer pad 52 and the camming foot 44.

Turning to FIGS. 5A, 5B and 6, for illustration purposes, a magnet 58 is shown installed into the foot 44 of the clamping assembly 42. The magnet 58 may be a discrete magnet 58 installed into a hole in the foot 44 of the clamping assembly 42. Similarly, the entire foot 44 may be formed from a magnetic material. Further, the magnet 58 may be a traditional natural magnet or a rare earth metal magnet. In either case, since the foot 44 of the clamping assembly 42 and the buffer pad 52 are typically formed from a ferrous material, the magnetic attractive force created by the installation of a magnet 58 is transferred through the foot 44 in a manner that attracts the buffer pad 52 against the foot 44. As the clamping assembly 42 is rotated to a disengaged position such that the camming foot 44 is withdrawn, the buffer pad 52 is also drawn outwardly against the side of the foot 44 and retained thereby the magnetic attractive force of the magnet 58.

In FIG. 5A the mounting assembly 30 can be seen in a closed engaged position. The actuator arm 50 is rotated against the body of the mounting assembly 30 and the foot 44 can be seen as being rotated to a position where it displaces the buffer pad 52 to engage the side of the dovetail rail 22 to firmly retain the mounting assembly 30 in an installed position. Turning now to FIG. 5B, the mounting assembly 30 can be seen in an open disengaged position. The actuator arm 50 is rotated outwardly to a position that is substantially perpendicular to the body of the mounting assembly 30. The foot 44 can be seen to be positioned in a fully disengaged position where it will not interfere with removal of installation of the mounting assembly 30 relative to the rail 22. It can further be seen that the buffer pad 52 is drawn outwardly against the foot 44 due to the magnetic attraction between the buffer pad 52 and the foot 44 so that the buffer pad 52 is also in a fully disengaged position where it will not interfere with removal of installation of the mounting assembly 30 relative to the rail 22.

Figure 7:
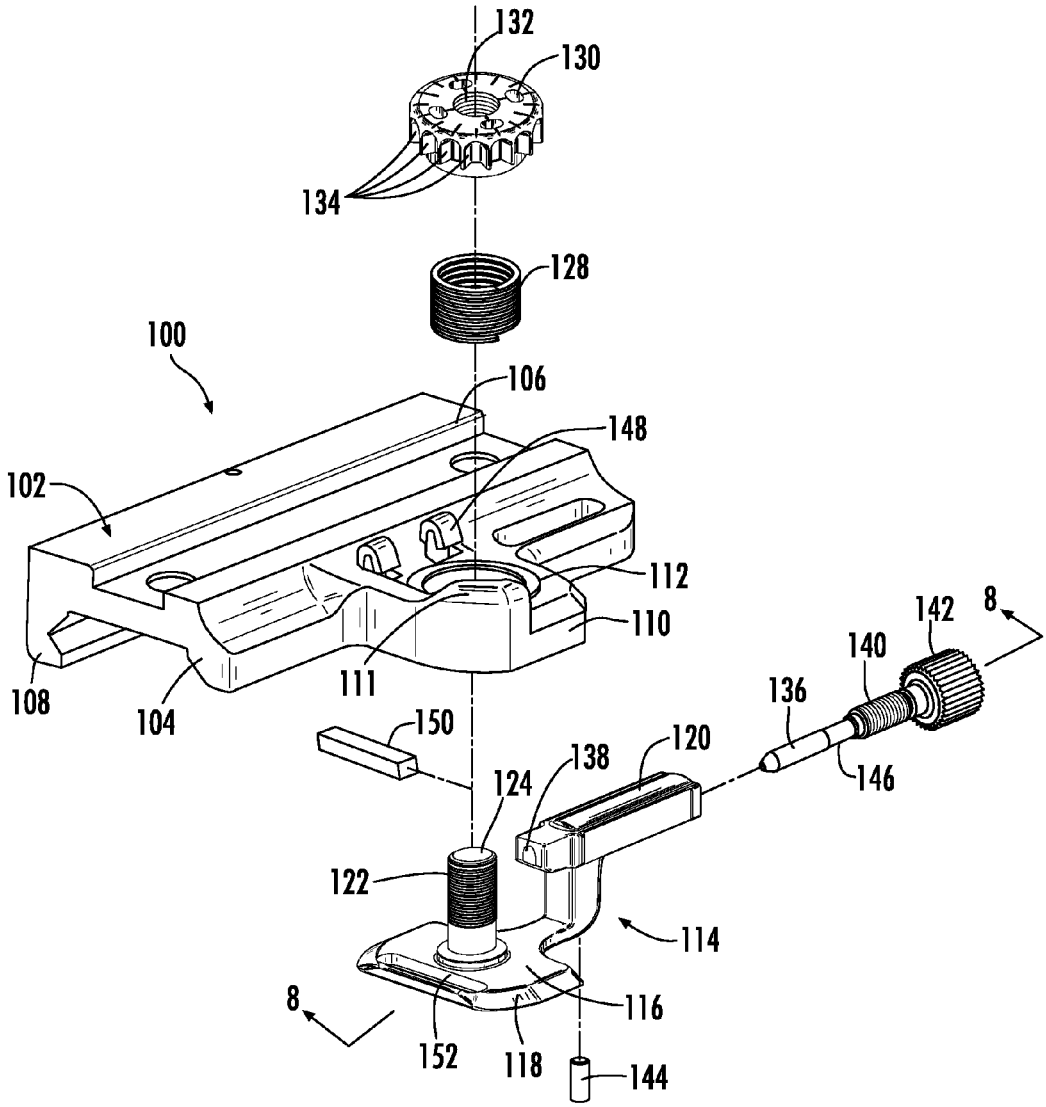
FIG. 7 is an exploded perspective view of an alternate embodiment of the mounting assembly of the present invention.
Figure 8:
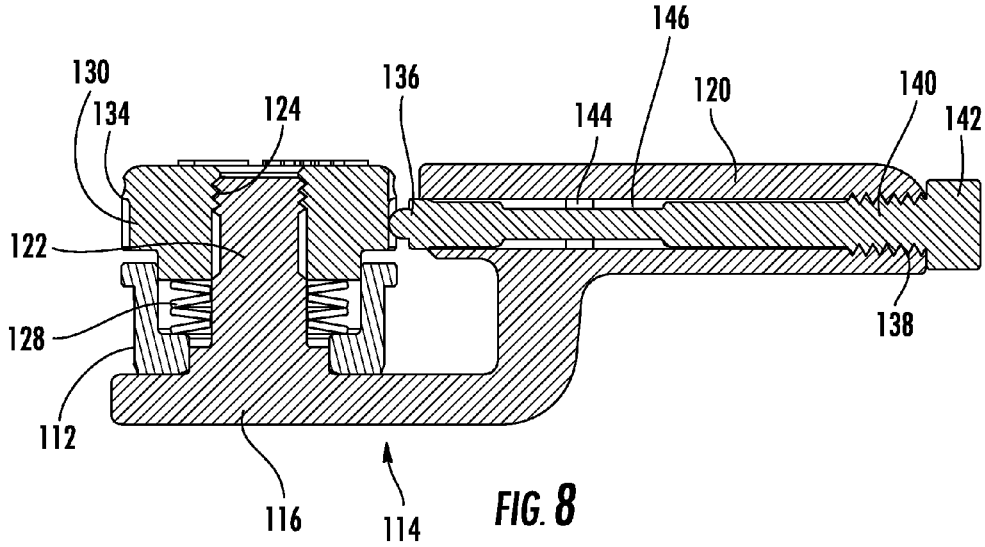
FIG. 8 is a cross sectional view taken along line 8-8 of FIG. 7.

Turning now to FIGS. 7 and 8, an alternative embodiment of the invention is illustrated and generally indicated at 100. Similar to the assembly described above, the mounting assembly 100 in this embodiment includes a main body 102 that is configured in substantially the same manner as a traditional prior art device and further includes a lower portion 104 that is configured to engage the dovetail rail 12 found on most modern combat weapons 2 and an upper portion 106 that can take on a variety of configurations depending on the accessory that is to be mounted thereon. The lower portion 104 of the main body 102 has a first engagement member 108 extending downwardly along one side thereof for engaging one side of the dovetail rail 12. Opposite the first engagement member 108, a boss formation 110 is provided adjacent the side of the main body 102. An annular bushing 112 is installed into the opening of the boss 110.

The clamping assembly 114 generally includes a foot portion 116 that is positioned adjacent the bottom surface of the boss 110 formation. The foot portion 116 includes an angulated cam surface 118 that extends around the side surface of the foot portion 116 as in the prior art devices. The foot portion 116 is configured as a dual sided foot so that only one foot and arm need be provided for both left and right hand mounting assemblies. The actuator arm 120 extends outwardly directly from the foot portion 116 below the boss formation 110 and allows the user to rotate the foot portion 116 between engaged and disengaged positions. A shaft 122 is affixed to and extends upwardly from the foot portion 116 through the bushing 112 and terminates in a threaded end 124.

At least one spring assembly 128 in the form of a spring such as a coil spring or spring washer is received around the shaft 122 and is seated on the bottom wall of the bushing 112.

A retention nut 130 having a threaded bore 132 is threadedly received on the threaded terminal end 124 of the shaft 122 such the spring 128 is captured between the bottom surface of the retention nut 130 and the upper surface of the bottom wall of the bushing 112. The spring 128 is compressed as the retention nut 130 is tightened thereby providing for adjustment of the initial spring tension of the clamping assembly 114. The boss formation 110 can also be seen to include a shoulder 111 that is configured to prevent rotation of the actuator arm 120 beyond the disengaged position (perpendicular to main body 102).

To insure that the retention nut 130 remains in a position as set by the user, the clamping assembly 114 further comprises a locking means for positively locking the position of the retention nut 130 on the threaded shaft 122. The locking means preferably comprises at least one locking formation (detent) 134 on the outer edge surface of the retention nut 130 and a locking pin 136. As shown in this embodiment, the detents 134 extend all the way around the outer surface of the retention nut 130 to provide a wide range of adjustment. The locking pin 136 is received within a bore 138 formed in the handle portion of the actuator arm 120. Threads 140 on the proximal end of the locking pin 136 adjacent a head portion 142 of the locking pin 136 engage complimentary threads within the bore 138 in the actuator arm 120. While the locking pin 136 can be displaced inwardly and outwardly relative to the actuator arm 120, the locking pin 136 is further held within the bore 138 by a roll pin 144 extending across the bore 138 and across a shoulder region 146 formed on the locking pin 136. The shoulder region 146 provides a sufficient amount of travel for retraction and engagement of the pin 136 but prevents it from falling out.

Since the spring 128 is trapped between the retention nut 130 and the bushing 112, tightening of the retention nut 130 causes compression of the spring 128, shortens the range of the vertical travel of the foot portion 116 relative to the bottom surface of the boss 110 and increases the spring clamping force. Accordingly, when the actuator arm 120 rotates the foot portion 116 into engagement with the rail 12, additional spring pressure is exerted on dovetail rail 12. Similarly, as the retention nut 130 is loosened, the compression of the springs 128 is reduced, the range of vertical travel of the foot portion 116 is increased, and the clamping force is reduced. In order to tighten or loosen the retention nut 130, the locking pin 136 is unthreaded relative to the actuator 120 until the distal end of the locking pin 136 is clear of the detents 134 in the retention nut 130 thereby allowing rotation of the retention nut 130 relative to the clamping assembly 114. After the retention nut 130 is adjusted and the desired spring tension is set, the locking pin 136 is threaded back into the bore 138 such that the distal end of the locking pin 136 engages one of the detents 134 on the retention nut 130 preventing rotation of the retention nut 130 relative to the clamping assembly 114.

There is also shown a steel buffer pad 148 as found in the earlier embodiments. Rotation of the actuator arm 120 causes rotation of the foot 116, which in turn serves to press the buffer element 148 into the side of the dovetail rail. As was provided above, magnetic attraction is employed as between the clamping assembly 114 and the buffer element 148 so that as the clamping assembly 114 is moved to the disengaged position, the magnetic force causes the buffer pad 148 to be withdrawn towards the clamping assembly 114 to a position that is clear from the second side of the dovetail rail 12. As can be seen, a magnet 150 is installed into a complementary opening 152 in the foot 116 and the buffer pad 148 is formed from a ferro-magnetic material so that a magnetic attraction exists between the buffer pad 148 and the magnetized camming foot 116. When the clamping assembly 114 is in a fully disengaged position the buffer pad 148 is drawn outwardly against the foot 116 due to the magnetic attraction between the buffer pad 148 and the foot 116 so that the buffer pad 148 is also in a fully disengaged position where it will not interfere with removal of installation of the mounting assembly 100 relative to the rail 12.

Figure 9:
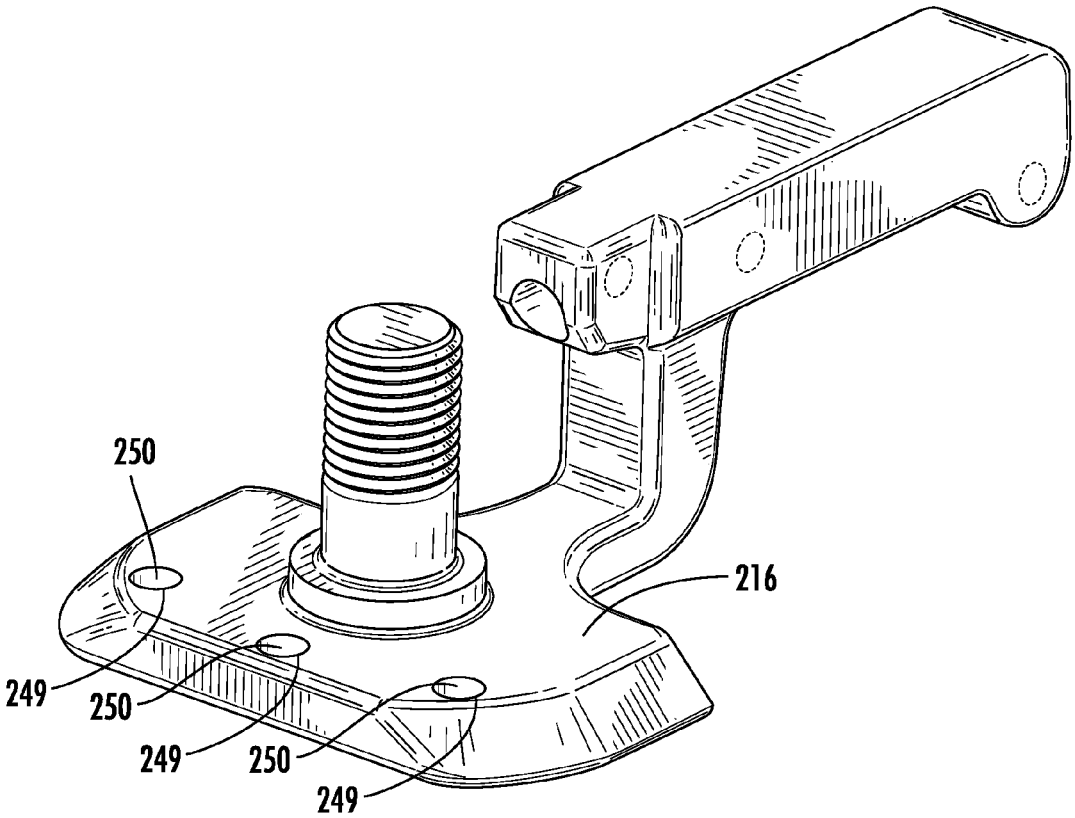
FIG. 9 is a perspective view of a second alternate embodiment of the mounting assembly of the present invention.

Turning to FIG. 9 another alternate embodiment of the clamping assembly is shown wherein the foot portion 216 is arranged to receive magnets 250 in an alternate configuration. As can be seen three openings 249 are provided to receive three magnets 250 in a distributed fashion along the foot 216. In all other respects, the clamping assembly of this embodiment operates as described above relating to FIGS. 7 and 8.

Accordingly, it can be seen that the present invention provides a unique and novel accessory mount that fills a critical need for soldiers in the field by ensuring positive and reliable operation. For these reasons, the instant invention is believed to represent a significant advancement in the art, which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A mounting assembly for attaching an accessory to a dovetail rail interface on a firearm, said mounting assembly comprising:

a body having a lower portion and an upper portion, said lower portion configured to engage a first side of said dovetail rail, said upper portion configured to receive and retain said accessory;

a boss formation extending outwardly from a side of said body and including an opening therein;

a clamping assembly configured to releasably engage a second side of said dovetail rail, including, a dual-sided foot portion positioned adjacent a bottom surface of said boss formation, said foot portion including symmetrically opposed first and second cam surfaces, and a bar magnet received in a complementary opening in a top surface of said foot portion, wherein said opening extends transversely across said foot portion between said opposed first and second cam surfaces, and further wherein a first end of said bar magnet is positioned adjacent said first cam surface and a second end of said bar magnet is position adjacent said second cam surface;

an actuator arm extending outwardly from said foot portion;

a shaft extending upwardly from said foot portion through said opening in said boss formation, a terminal end of said shaft being threaded;

a spring received around said shaft adjacent the top surface of said boss formation; and a retention nut threadedly received on said terminal end of said shaft such that said spring is captured between a bottom surface of said retention nut and a top surface of said boss formation; and a buffer pad formed from a ferro-magnetic material pivotally mounted to said body adjacent a bottom surface of said lower portion and adjacent said clamping assembly, wherein movement of said clamping assembly to an engaged position causes said foot portion to clamp said buffer pad against said second side of said dovetail rail and wherein movement of said clamping assembly to a disengaged position magnetically withdraws said buffer pad away from said dovetail rail due to a magnetic attraction between said buffer pad and a respective end of said magnet in said foot portion.

2. The mounting assembly of claim 1, wherein said retention nut further comprises means for engaging said shaft to prevent accidental rotation of said retention nut relative to said shaft.

3. The mounting assembly of claim 2, wherein said boss formation includes a shoulder formation configured and arranged to prevent rotation of said actuator arm beyond a disengaged position.

4. The mounting assembly of claim 1, wherein said clamping assembly further comprises an locking assembly configured and arranged to allow a user to positively lock the position of said retention nut on said threaded shaft.

5. The mounting assembly of claim 1, wherein said boss formation includes a shoulder formation configured and arranged to prevent rotation of said actuator arm beyond a disengaged position.

6. A mounting assembly for attaching an accessory to a dovetail rail interface on a firearm, said mounting assembly comprising:

a body having a lower portion and an upper portion, said lower portion configured to engage a first side of said dovetail rail, said upper portion configured to receive and retain said accessory;

a boss formation extending outwardly from a side of said body and including an opening therein;

a clamping assembly configured to releasably engage a second side of said dovetail rail, including, a foot portion positioned adjacent a bottom surface of said boss formation, said foot portion including a cam surface and at least one magnet positioned in a complementary opening in a top surface of said foot portion adjacent to said cam surface;

an actuator arm extending outwardly from said foot portion;

a shaft extending upwardly from said foot portion through said opening in said boss formation, a terminal end of said shaft being threaded;

a spring received around said shaft adjacent the top surface of said boss formation;

a retention nut threadedly received on said terminal end of said shaft such that said spring is captured between a bottom surface of said retention nut and a top surface of said boss formation;

a locking pin threadedly received through a bore in said actuator arm, said locking pin configured and arranged to selectively engage and lock the position of said retention nut on said threaded shaft, and a buffer pad formed from a ferro-magnetic material pivotally mounted to said body adjacent a bottom surface of said lower portion and adjacent said clamping assembly, wherein movement of said clamping assembly to an engaged position causes said foot portion to clamp said buffer pad against said second side of said dovetail rail and wherein movement of said clamping assembly to a disengaged position magnetically withdraws said buffer pad away from said dovetail rail due to a magnetic attraction between said buffer pad and said magnet in said foot portion.

7. The mounting assembly of claim 6, wherein said boss formation includes a shoulder formation configured and arranged to prevent rotation of said actuator arm beyond a disengaged position.

8. The mounting assembly of claim 6, wherein said at least one magnet is a single magnet.

9. The mounting assembly of claim 6, wherein said at least one magnet is an array of three magnets.

* * * * *